US005291177A

United States Patent [19]

Chiu

[11] Patent Number: 5,291,177

[45] Date of Patent: Mar. 1, 1994

[54] VARIABLE RESISTOR

[75] Inventor: Kun-Low Chiu, Taipei, Taiwan

[73] Assignee: Yung Chang Industrial Co., Ltd., Taiwan

[21] Appl. No.: 971,457

[22] Filed: Nov. 4, 1992

[51] Int. Cl.[5] ..... H01C 10/32

[52] U.S. Cl. ..... 338/166; 338/167; 338/173

[58] Field of Search ..... 338/166, 167, 173, 185, 338/132, 134, 162

[56] References Cited

U.S. PATENT DOCUMENTS

| | | | |
|---|---|---|---|
| 1,466,293 | 8/1923 | Brooks | 338/166 X |
| 3,676,822 | 7/1972 | Slagg et al. | 338/166 X |
| 3,902,152 | 8/1975 | Van Benthuysen | 338/162 |
| 4,353,053 | 10/1982 | Matsui et al. | 338/132 |
| 4,523,175 | 6/1985 | Sakurai | 338/134 |

*Primary Examiner*—Marvin M. Lateef

*Attorney, Agent, or Firm*—Ostrolenk, Faber, Gerb & Soffen

[57] ABSTRACT

A variable resistor includes a case inside which a rotatable member with a resistive element mounted thereon is disposed with a separate rotatable shaft running through a hole formed thereon, a stationary member with external leads attached thereon overlapping the rotatable member with the shaft further running therethrough and extending out thereof to be engaged by a turning knob. The stationary member is secured on the case to form a part thereof. The rotatable shaft is constituted by two segments, an upper segment and a lower segment. A spring is provided between the lower shaft segment and the case to bias the shaft to abut against the rotatable member with an annular flange formed on one end thereof so that when nubs which are formed on the annual flange respectively engage with the corresponding recesses formed on the rotatable member, the rotatable member will follow the rotation of the shaft. The spring is so selected that when the torque transmitted between the shaft and the rotatable member is greater than a pre-determined value, the engagement between the shaft and the rotatable member will be broken. The upper segment of the rotatable shaft is removable from the variable resistor and thus replaceable with a substitute having different configurations for different purposes.

9 Claims, 3 Drawing Sheets

VARIABLE RESISTOR

FIELD OF THE INVENTION

The present invention relates generally to a variable resistor structure and in particular to the improvement in the shaft thereof.

BACKGROUND OF THE INVENTION

Variable resistors have been found widely useful in versatile mechanical instruments and electrical or electronic devices. Most commonly, the variable resistors are serving as adjusting and/or controlling elements for many kinds of signals, for example volume level of sound generating devices, light intensity of laminating means, temperature of heating apparatus, etc. The variable resistor also finds its usefulness in device calibration.

To meet the requirements for different devices or different purposes, heretofore, several kinds of variable resistors have been developed. These conventional variable resistors, although useful, possess certain disadvantages. For example, the most common disadvantage noted in the conventional variable resistor is that the conventional variable resistor is easy to be damaged when a user applies such a greater torque to rotate the shaft of a variable resistor that the rotatable member, of which the rotation is limited by stopper means, unexpectedly overlaps or breaks the stopper means and thus damaging the whole structure thereof.

Even if such an over-rotation does not damage the variable resistor directly, it also increases the abrasion and wear between parts of the variable resistor and thus shortening the duty life of the variable resistor.

Besides, such an over-rotation may also cause short circuit and thus deteriorating or totally destroying the function of the variable resistor.

Furthermore, the over-rotation may also result in a permanent deformation of the parts and eventually makes the variable resistor malfunction.

It is therefore desirable to have an improved variable resistor which overcomes the above-mentioned drawbacks.

OBJECTS OF THE INVENTION

Thus the primary object of the present invention is to provide a variable resistor of which the structure is improved over the conventional ones and thus overcoming the above-mentioned drawbacks.

It is another object of the present invention to provide a variable resistor wherein over turning the shaft to have the rotatable member unexpectedly overlapping other parts is prevented by means of resilient element.

It is a further object of the present invention to provide a variable resistor wherein by the provision of a resilient element, damages caused by over-rotation is greatly reduced.

It is a further object of the present invention to provide a variable resistor wherein temperature-resistant insulating material, such as plastic materials or Bakelite, are incorporated to improve the deformation or short circuit resistant capability.

It is a further object of the present invention to provide a variable resistor which comprises an audio warning signal device to notify a user the occurrences of over-rotation.

It is a further object of the present invention to provide a variable resistor which has a rotation shaft constituted by two segments, one of the segments being withdrawable therefrom to be replaced with a substitute member so that the variable resistor is fit for different devices.

To achieve the above-mentioned objects, there is provided a variable resistor comprising a case inside which a rotatable member with a resistive element mounted thereon is disposed with a separate rotatable shaft running through a hole formed thereon, a stationary member with external leads attached thereon overlapping the rotatable member with the shaft further running therethrough and extending out thereof to be engaged by a turning knob. The stationary member is secured on the case to form part thereof. The rotatable shaft is constituted by two segments, an upper segment and a lower segment. A spring is provided between the lower shaft segment and the case to bias the shaft to abut against the rotatable member with an annular flange formed on one end thereof so that when nubs which are formed on the annual flange respectively engage with the corresponding recesses formed on the rotatable member, the rotatable member will follow the rotation of the shaft. The spring is so selected that when the torque transmitted between the shaft and the rotatable member is greater than a pre-determined value, the engagement between the shaft and the rotatable member will be broken. The upper segment of the rotatable shaft is withdrawable from the variable resistor and thus replaceable with a substitute having different configuration for different purposes.

Other objects and advantages of the invention will be apparent from the following description of a preferred embodiment taken in connection with the accompanying drawings wherein:

DETAILED DESCRIPTION OF THE PREFERRED EMBODIMENT

Figure 1:
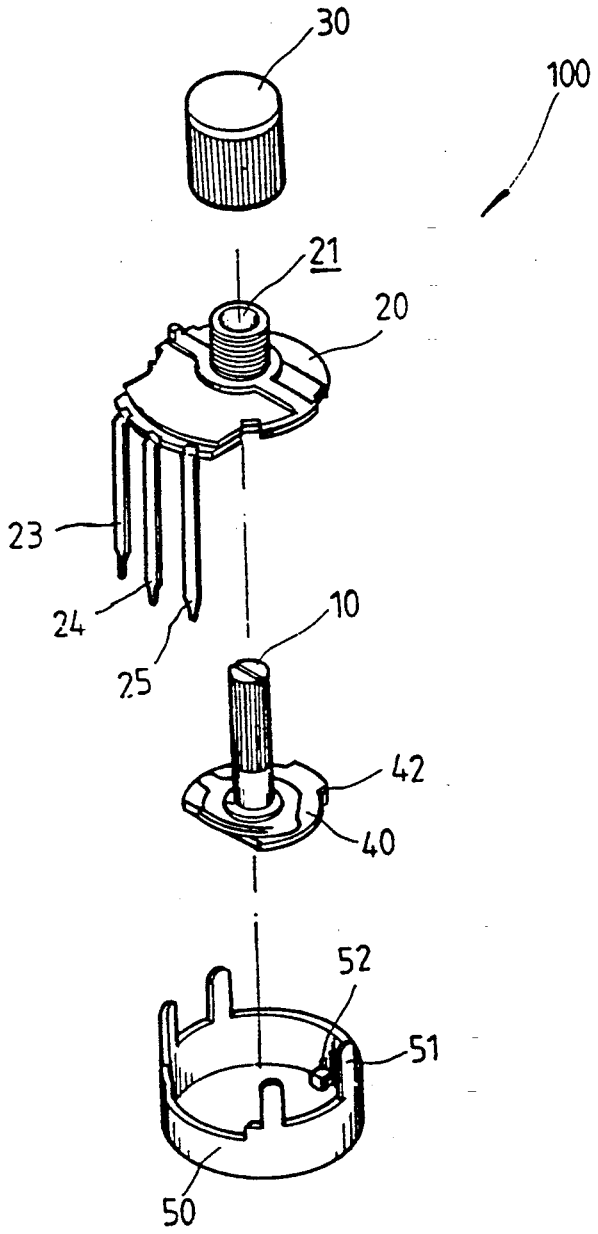
FIG. 1 PRIOR ART
FIG. 1 is an exploded fragmentary view of a conventional commercially-available variable resistor.

Referring to the drawings and in particular to FIG. 1 thereof, wherein a conventional variable resistor 100 is shown, the conventional variable resistor 100 comprises a case 50 inside which a rotatable member 40 with a shaft 10 extending therefrom is disposed. The shaft 10 is secured on the rotatable member 40 as a whole for rotating the rotatable member 40. A stationary member 20 overlaps the rotatable member 40 with a bore 21 formed thereon to allow the shaft 10 to penetrate therethrough to be engaged by a turning knob 30.

The stationary member 20 is secured to the case 50 to form part thereof and has leads 23, 24 and 25 extending out thereof to serve as external terminals of the variable resistor 100. The case 50 has a stopper 52 formed on an inner surface thereof to cooperate with a projection 42 formed on the rotatable member 40 to limit the rotation angle of the rotatable member 40.

As mentioned previously, one of the disadvantages of the conventional variable resistors, like the on shown in FIG. 1, is the lack of self-protection mechanism so that when the shaft 10 is rotated with a torque which is greater to such an extent that the stopper 52 or the projection 42 cannot afford or firmly and stably support each other, the projection 42 may suddenly slip over and overlap on or under the stopper 52, and the stopper 52 and/or the projection 42 may be damaged.

Figure 2:
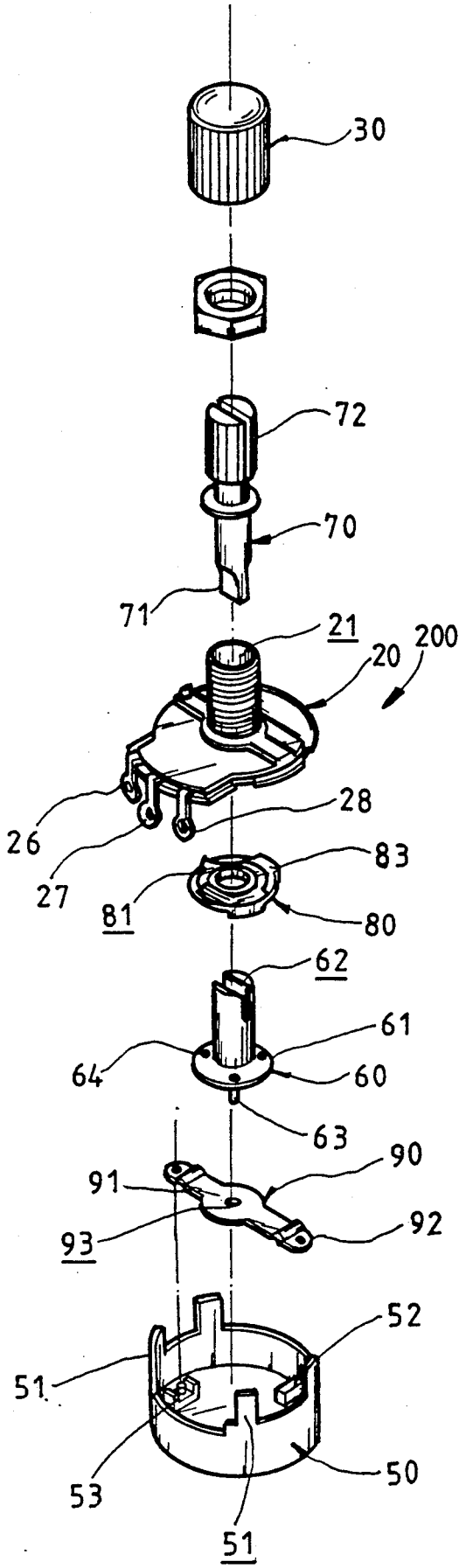
FIG. 2 is an exploded fragmentary view of a variable resistor in accordance with the present invention.

To overcome the disadvantage of the conventional variable resistors, such as that shown in FIG. 1, the present invention provides an improved structure of the variable resistor which is shown in FIG. 2 wherein similar parts as those shown in FIG. 1 are designated by similar reference numerals.

The improved variable resistor in accordance with the present invention, generally designated by the reference 200, comprises a case 50, inside which a stopper 52 (with the similar function of the counterpart thereof shown in FIG. 1) is provided against an inner surface thereof. A rotatable member 80 having a center hole 81 is disposed inside the case 50 with a stationary member 20 which has a center bore 21 overlapping thereon. The stationary member 20 is secured on the case 50 by means of, for example, deformable strips 51 which are attached on the case 50. The strips 51, after being bent inward, abut on the stationary member 50 and thus securely hold the same on the case 50.

Resistive element (not shown), preferably in the form of a strip forming an open ring, is mounted on the rotatable member 80 and rotatable therewith. Such an open ring provides different resistance between any two points thereof which have therebetween different distance along the curved length of the open ring. This is well known to the art and thus no detail will be given detail.

The case 50 may be made of a temperature resistant insulating material, such as some plastic materials or Bakelite, to provide a better protection against deformation or short circuit.

A rotation shaft which is constituted by two segments 60 and 70 is separated from the rotatable member 80. This is different from the conventional structure in which the shaft is integrated on the rotatable member. The first segment or the lower segment 60 which has an annular, radial flange 61 formed on a first end thereof is rotatably disposed in such a way that the first end thereof is located between the case 50 and the rotatable member 80 and a second end thereof runs through the center hole 81 of the rotatable member 80 and partially penetrating into the center bore 21 of the stationary member 20. An engaging slot 62 is formed on the second end of the first segment 60 and a guiding pin 63 is formed on the first end thereof. The second segment or the upper segment 7 has a first end partially insertable into the center bore 21 of the stationary member 20. The first end thereof has an engaging plate 71 which is engagably receivable in the engaging slot 62 of the first segment 60. The upper segment 70 further has an adaptor portion 72 formed on a second end thereof to be engaged by a turning knob 30. The purpose of the turning knob 30 is to facilitate the rotation of the shaft segments 60 and 70 with human hands (not shown).

The leads 23, 24 and 25 shown in FIG. 1 may be embodied with a different form as that designated by the reference numerals 26, 27 and 28 in FIG. 2. Their function is the same. The two sideways leads 26 and 28 are respectively in electrical connection with the ends of the resistive element, which as explained previously is not shown in the drawings, and the central lead 27 is associated with a "neutral" position of the resistive element so that when the resistive element is rotated with the rotatable member 80, the distance along the curve of the resistive element between the sideways leads and the central lead are changed and thus resistances therebetween change. This is exactly the same as the conventional variable resistors and thus no further detailed description will be necessary.

A spring 90 is provided between the first end of the lower shaft segment 60 and the case 50 to force the flange 61 to move toward the rotatable member 80 and abut against the same. The spring 90 is preferably a leaf spring having two opposite end portions 91 and 92 which are respectively secured on support means 53 and 54 formed on the case 50. The spring plate 90 also comprises a central recess 93 corresponding to the guiding pin 63 formed on the first end of the lower shaft segment 60 to receive and engage the guiding pin 63 therein. It is obvious that spring of other type, such as a helical spring, can also be used to replace the leaf spring 90 of the preferred embodiment.

On a surface of the flange 61 which is opposing the rotatable member 8 is provided at least a nub 64 and preferably more than one evenly distributed along the flange 61. Corresponding to the nub 64, a recess 82 (see FIGS. 3 and 4) complementary in size and shape is formed on a surface of the rotatable member 80 which is opposing the flange 61 to engagably receive the nub 64 therein. The number of the recesses 82 should be at least the same as that of the nubs 64.

Figure 4:
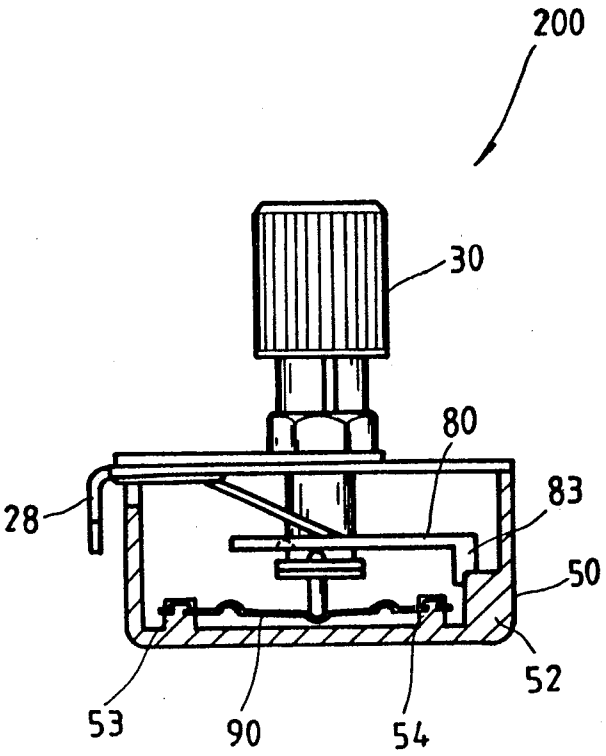
FIG. 4 is a cross-sectional view similar to FIG. 3, showing the situation when the engagement between the shaft and the rotatable member is broken.
Figure 3:
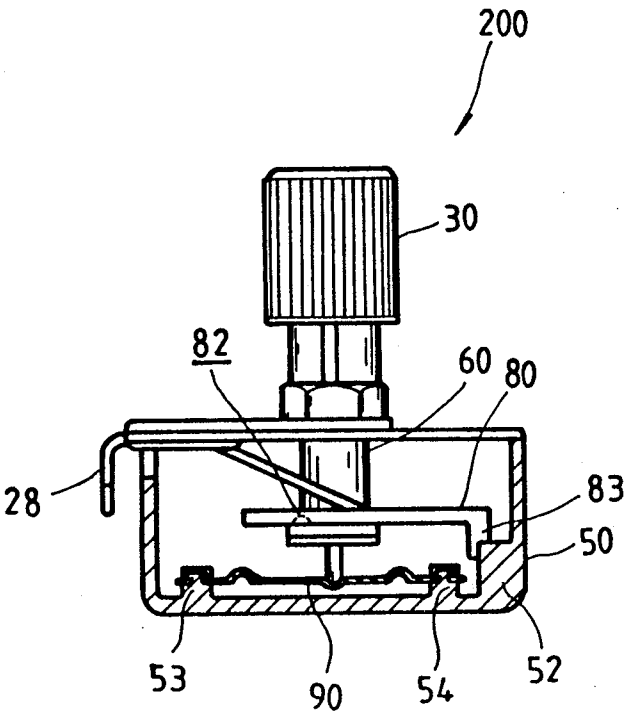
FIG. 3 is a cross-sectional view of the variable resistor of the present invention, showing the engagement of the shaft and the rotatable member.

Referring now to FIGS. 3 and 4, in a normal situation, the nubs 64 engage with the recesses 82 as shown in FIG. 3. And the rotation of the upper shaft segment 70 and the lower shaft segment 6 by the knob 30 is transmitted to the rotatable member 80 via the engagement of the nubs 64 and the recesses 82 which is maintained by the biasing force of the spring 90. The rotation of the rotatable member 80 is limited when a projection 83 formed on the rotatable member 80 encounters the stopper 52 and is stopped thereby.

The transmission of the rotation is controlled by the biasing force of the spring 90. When the torque transmitted therebetween its greater than a value determined essentially by the spring force, the engagement between the shaft segment 60 and the rotatable member 80 will be broken due to the fact that the nubs 64 are forced to move out of the recess 82. This situation may happen when the projection 83 of the rotatable member 80 has already stopped by the stopper 52 while an external torque which is greater than the engagement between the shaft segment 60 and the rotatable member 80 can afford is still applied to the knob 30. This is shown in FIG. 4.

With such a self-protection mechanism, the projection 83 of the rotatable member 80 and the stopper 52 can be well protected from damage and overlapping and once an over-rotation occurs, the continuous disengagements and engagements between the nubs 64 and the recesses 82 generates a click sound to warn the user (not shown) of the over-rotation.

It is apparent that although the invention has been described in connection with a preferred embodiment, it is contemplated that those skilled in the art may make changes to certain features of the preferred embodiment without departing from the spirit and scope of the invention as defined in the appended claims.

What is claimed is:

1. A variable resistor comprising a case inside which a rotatable member having a resistive element mounted thereon is disposed and a stationary member which overlaps the rotatable member and has three leads extending therefrom, said stationary member being secured on said case by a securing means, said leads respectively in connection with said resistive element at different locations thereof and extending out of said case to serve as external terminals, said case having a stopper mounted therein in such a position that when the rotatable member is rotated to a pre-determined limit thereof, a projection formed on said rotatable member encounters said stopper and stopped thereby to limit the rotation of said rotatable member, wherein the improvements comprise:

said variable resistor further comprises a rotation shaft which has a first end disposed between said case and said rotatable member and a second end running through a central hole formed on said rotatable member and a central bore formed on said stationary member and protruding out of said central bore to be engaged by a turning knob for providing rotation thereto, said rotation shaft having an annual radial flange formed on the first end thereof and being rotatably disposed in such a way to have the annual flange thereof disengageably engage said rotatable member with a retaining means so that when said rotation shaft is rotated to have said projection of the rotatable member encounter said stopper and a further rotation is applied on said rotation shaft, said rotatable member disengages from said shaft.

2. A variable resistor as claimed in claim 1 wherein said retaining means comprises at least a nub formed on a surface of said flange which is opposing said rotatable member and a number of recesses are formed on said rotatable member opposing said nubs, said recesses being at least the same number of said nubs and complementary in size and shape with said nubs so that said nubs are insertable into said recesses, a biasing means providing a biasing force to push said flange of the rotation shaft toward said rotatable member in such a way that said nubs are forced to remain within said recesses and thus retaining said rotation shaft and rotatable member to rotate together when said rotation shaft is rotated, and when said projection encounters said stopper and a further rotation is applied to said rotation shaft to overcome said biasing force, said rotatable member disengages from said rotation shaft.

3. A variable resistor as claimed in claim 2 wherein said biasing means comprises a spring disposed between the first end of said rotation shaft and said case.

4. A variable resistor as claimed in claim 3 wherein said spring is a leaf spring having two opposite end portions respectively secured on a support formed on said case and a central recess for receiving and engaging therein a guiding pin formed on the first end of the rotation shaft to provide the biasing force.

5. A variable resistor as claimed in claim 1 further comprising an audio warning means.

6. A variable resistor as claimed in claim 5 wherein said audio warning means comprises a plurality of nubs formed on a surface of said flange which is opposing said rotatable member and a corresponding number of recesses formed on said rotatable member opposing said nubs, said recesses being complementary in size and shape with said nubs so that said nubs are insertable into said recesses, a biasing means providing a biasing force to push said flange toward said rotatable member in such a way that when said nubs are repeatedly forced to slip out of the recesses inside which they are staying and slide to the recesses next to where they are staying, a click sound is generated.

7. A variable resistor as claimed in claim 7 wherein said biasing means comprises a spring.

8. A variable resistor as claimed in claim 1 wherein said rotation shaft comprises a lower segment and an upper segment, said lower segment having said annular radial flange and said nubs formed thereon and said upper segment being withdrawably inserted into the central bore of said stationary member, a releasable engagement being formed between said upper segment and said lower segment to form said rotation shaft.

9. A variable resistor as claimed in claim 1 wherein said case is made of a temperature-resistant insulating material, such as temperature resistant plastic material.

* * * * *